US008020723B2

(12) United States Patent
Auer et al.

(10) Patent No.: US 8,020,723 B2
(45) Date of Patent: Sep. 20, 2011

(54) REMOVABLE LOCKING CONTAINER LID WITH OUTER SKIRT

(75) Inventors: Robert Thomas Auer, East Stroudsburg, PA (US); Jason Wesley Stull, Morristown, NJ (US)

(73) Assignee: Stull Technologies, Inc., Somerset, NJ (US)

( * ) Notice: Subject to any disclaimer, the term of this patent is extended or adjusted under 35 U.S.C. 154(b) by 1113 days.

(21) Appl. No.: 11/824,790

(22) Filed: Jul. 2, 2007

(65) Prior Publication Data

US 2008/0116202 A1 May 22, 2008

Related U.S. Application Data

(60) Provisional application No. 60/866,259, filed on Nov. 17, 2006.

(51) Int. Cl.
*B65D 41/16* (2006.01)

(52) U.S. Cl. ..... 220/780; 220/203.11; 220/793; 220/305; 220/203.02

(58) Field of Classification Search ..... 220/203.02, 220/203.11, 780, 793, 281, 305, 786; 215/216, 215/209

See application file for complete search history.

(56) References Cited

U.S. PATENT DOCUMENTS

| | | | | |
|---|---|---|---|---|
| 247,547 | A | | 9/1881 | Eisemann |
| 471,911 | A | | 3/1892 | Sutro |
| 1,482,931 | A | | 2/1924 | Keehn |
| 2,205,685 | A | | 9/1936 | Conner |
| 2,695,806 | A | | 2/1953 | Balint |
| 3,083,861 | A | * | 4/1963 | Amberg et al. ..... 220/371 |
| 3,432,087 | A | | 3/1969 | Costello |
| 3,642,161 | A | * | 2/1972 | Stroud ..... 215/213 |
| 3,688,942 | A | * | 9/1972 | Mitchell et al. ..... 220/784 |
| 3,703,975 | A | * | 11/1972 | Wittemer ..... 215/213 |
| 3,868,041 | A | | 2/1975 | Knize |
| 3,885,712 | A | | 5/1975 | Libit ..... 222/153.14 |

(Continued)

FOREIGN PATENT DOCUMENTS

JP 2003146373 5/2003

(Continued)

OTHER PUBLICATIONS

"DixieWare Round Containers with Microwave Vent, 32 Ounces"; http://www.epinions.com/pr-Housewares-DixieWare_Round_Containers_With_Microwave; Jun. 28, 2007.

*Primary Examiner* — Anthony Stashick
*Assistant Examiner* — Christopher McKinley
(74) *Attorney, Agent, or Firm* — Drinker Biddle & Reath LLP

(57) ABSTRACT

A container lid for use with a container with a neck. The lid includes a top and bottom, a skirt extending downward from the circumference of the lid, and a circumferential flange extending radially outward from the lid. The skirt preferably includes at least one integral bead shaped to engage the neck or rim of the container. The lid preferably includes a convex center section including at least one vent. The at least one vent is preferably integral with the lid, and is opened by the steam pressure buildup inside the container when the contents are heated. When the cover is locked on the container, the skirt provides a seal against the outside of the container neck.

12 Claims, 4 Drawing Sheets

U.S. PATENT DOCUMENTS

| | | | | | |
|---|---|---|---|---|---|
| 3,964,634 | A | | 6/1976 | Jasinski et al. | |
| 4,014,452 | A | | 3/1977 | Galer | |
| 4,020,969 | A | | 5/1977 | Ando | |
| 4,079,857 | A | | 3/1978 | Crisci | |
| 4,119,239 | A | | 10/1978 | Anderson | 220/324 |
| 4,141,487 | A | | 2/1979 | Faust et al. | |
| 4,209,107 | A | | 6/1980 | Crisci | |
| 4,210,258 | A | | 7/1980 | von Holdt | |
| 4,210,674 | A | | 7/1980 | Mitchell | |
| 4,230,235 | A | * | 10/1980 | Di Amico | 220/710.5 |
| 4,244,920 | A | * | 1/1981 | Manschot et al. | 422/102 |
| 4,349,119 | A | | 9/1982 | Letica | |
| 4,387,828 | A | | 6/1983 | Yates, Jr. | |
| 4,390,110 | A | * | 6/1983 | Pirro | 220/318 |
| 4,480,762 | A | | 11/1984 | Thomas | |
| 4,526,289 | A | | 7/1985 | Schiemann | 220/304 |
| 4,530,440 | A | * | 7/1985 | Leong | 220/201 |
| 4,579,257 | A | | 4/1986 | Brandlein | 222/192 |
| 4,595,111 | A | * | 6/1986 | Gould et al. | 215/303 |
| 4,676,388 | A | | 6/1987 | Kuboshima | 215/217 |
| 4,687,112 | A | | 8/1987 | Swartzbaugh | |
| 4,718,571 | A | | 1/1988 | Bordner | |
| 4,752,013 | A | * | 6/1988 | Miller et al. | 215/216 |
| 4,752,014 | A | | 6/1988 | House et al. | 215/216 |
| 4,815,628 | A | * | 3/1989 | Wehnert, III | 220/796 |
| 4,949,865 | A | | 8/1990 | Turner | 220/713 |
| 5,042,683 | A | | 8/1991 | Shaw et al. | |
| 5,180,072 | A | * | 1/1993 | Oehlert | 215/209 |
| D334,324 | S | * | 3/1993 | Pierce | D7/605 |
| 5,232,116 | A | | 8/1993 | Baxter | |
| 5,292,017 | A | * | 3/1994 | Reifers | 215/206 |
| 5,310,981 | A | | 5/1994 | Samoff et al. | 219/731 |
| D353,444 | S | * | 12/1994 | Merrett | D23/260 |
| 5,375,730 | A | | 12/1994 | Bahr et al. | 220/324 |
| 5,377,860 | A | * | 1/1995 | Littlejohn et al. | 220/790 |
| 5,449,077 | A | * | 9/1995 | Seidler | 215/216 |
| 5,452,818 | A | * | 9/1995 | Yost | 220/258.2 |
| 5,518,133 | A | * | 5/1996 | Hayes et al. | 220/793 |
| 5,558,240 | A | * | 9/1996 | Karp | 215/398 |
| 5,603,421 | A | | 2/1997 | Opresco | |
| 5,695,086 | A | * | 12/1997 | Viola | 220/287 |
| 5,706,963 | A | | 1/1998 | Gargione | |
| 5,769,258 | A | | 6/1998 | Harrison et al. | 220/203.1 |
| 5,833,116 | A | * | 11/1998 | Guillin | 220/783 |
| 5,865,330 | A | | 2/1999 | Buono | |
| 5,881,907 | A | | 3/1999 | Schutz | |
| 5,894,953 | A | * | 4/1999 | Ramirez | 220/785 |
| 5,908,125 | A | | 6/1999 | Opresco | 215/216 |
| 5,915,581 | A | * | 6/1999 | Pfirrmann et al. | 220/4.21 |
| 5,921,417 | A | * | 7/1999 | Mull | 215/216 |
| 5,927,526 | A | | 7/1999 | Herr | |
| 5,960,979 | A | * | 10/1999 | Van Den Brink et al. | 220/266 |
| 5,988,426 | A | | 11/1999 | Stern | |
| 6,036,036 | A | | 3/2000 | Bilani et al. | |
| 6,047,852 | A | * | 4/2000 | Evans et al. | 220/793 |
| 6,056,138 | A | | 5/2000 | Chen | |
| 6,112,921 | A | * | 9/2000 | Robinson | 215/216 |
| 6,202,869 | B1 | | 3/2001 | Sullivan | |
| 6,296,130 | B1 | | 10/2001 | Forsyth et al. | |
| 6,315,146 | B1 | * | 11/2001 | Johnsen | 220/319 |
| 6,364,152 | B1 | | 4/2002 | Poslinski et al. | |
| 6,431,385 | B1 | | 8/2002 | Palmer | 220/324 |
| 6,439,409 | B1 | * | 8/2002 | Dressel et al. | 215/228 |
| 6,460,716 | B1 | | 10/2002 | Wong | |
| 6,575,323 | B1 | | 6/2003 | Martin et al. | |
| D478,282 | S | * | 8/2003 | Hayes et al. | D9/425 |
| 6,607,089 | B2 | * | 8/2003 | Ferguson | 220/367.1 |
| 6,612,450 | B1 | | 9/2003 | Buono | 215/228 |
| 6,644,494 | B2 | * | 11/2003 | Hayes et al. | 220/839 |
| 6,910,599 | B2 | * | 6/2005 | Tucker et al. | 220/793 |
| 6,923,338 | B2 | * | 8/2005 | Dees et al. | 220/793 |
| 7,063,231 | B2 | * | 6/2006 | Stanos et al. | 220/793 |
| 7,823,746 | B1 | * | 11/2010 | McCumber | 220/780 |
| 2002/0148845 | A1 | * | 10/2002 | Zettle et al. | 220/781 |
| 2003/0085227 | A1 | | 5/2003 | Azzarello | |
| 2005/0145627 | A1 | * | 7/2005 | Stull et al. | 220/254.3 |
| 2005/0199630 | A1 | | 9/2005 | Haamer | |
| 2005/0233035 | A1 | | 10/2005 | Smith | |
| 2006/0255041 | A1 | * | 11/2006 | Parks et al. | 220/301 |
| 2006/0255052 | A1 | * | 11/2006 | Svitak | 220/780 |
| 2007/0012710 | A1 | * | 1/2007 | Vovan | 220/793 |
| 2008/0110911 | A1 | * | 5/2008 | Chen | 220/788 |

FOREIGN PATENT DOCUMENTS

| | | |
|---|---|---|
| JP | 2006298467 | 11/2006 |
| WO | WO 91/02685 | 3/1991 |
| WO | WO 2006/092562 | 9/2006 |

* cited by examiner

REMOVABLE LOCKING CONTAINER LID WITH OUTER SKIRT

CROSS-REFERENCE TO RELATED APPLICATION

This application is related to and claims priority from U.S. Provisional Patent Application No. 60/866,259, filed on Nov. 17, 2006, which is hereby incorporated by reference in its entirety.

FIELD OF THE INVENTION

The present invention relates generally to removable lids or covers for containers, and more particularly, to removable and reusable lids or covers for use with microwavable containers.

BACKGROUND OF THE INVENTION

It is known to provide a removable cover or lid for a container, such as a container of food or drink. Many such containers can be placed in a microwave oven to heat their contents. The cover or closure functions to prevent the contents of the container from spilling when the container is moved, or splattering when being heated in the microwave. However, many prior art container covers have suffered from deficiencies. Depending on their construction, they may be difficult to put on or to remove, or may be too easily removed, thereby resulting in inadvertent removal of the cover.

It is desirable to provide a cover or lid which is easier to put onto and take off of a container, inhibits inadvertent removal, and that seals more dependably.

SUMMARY OF THE INVENTION

The present invention relates to an improved removable lid. The lid is formed as a one piece injection molded lid with hinged venting doors formed in the top. The lid has particular use with microwavable products, but can be used on a variety of other types of products.

The lid includes a locking system designed to secure the lid to a rim on a container. The locking system includes a skirt that extends downward from the top of the lid. A flange is formed completely around the outside of the skirt. The flange preferably includes at least a first portion extending radially outward from the top of the skirt and at least a second portion that projects radially outward from the bottom of the skirt. The flange includes transition sections between the first and second portions where the flange steps diagonally from the bottom of the skirt to the top of the outside wall. The second portion of the flange preferably includes finger grips to assist in grasping by the user. Although the present embodiment of the invention shows a diagonal transition section, it is contemplated that the transition from the first to the second portions of the flange could be made in various forms, e.g., a vertical step or a nonlinear, curved transition.

On the inside wall where the flange is located at the base of the skirt (i.e., at the second portion) one or more integrally molded beads act as locks when placed over a container rim.

When the lid is lifted from the bottom of the grips, the lid flexes. The transition flange sections transfer the flexing load from the second portion of the flange—where the grips are located—to the first portion of the flange extending from the top of the skirt. This helps the lid to bend and the skirt to flex outward, permitting the beads to slide up over the container rim as the lid is removed. Thus, the lid is aided in flexing and the inside locks disengage when the lid is being lifted from the grips due to the construction and location of the outside flange transition sections.

Preferably there are two portions of the flange that are located at the bottom of the skirt and that include finger grips. These two portions are preferably on opposite sides of the container lid. Thus, the lid can be removed from the container with either hand or by using either bottom grip area. While the flange is shown as a series or recessed finger grips, such recesses are only preferred and are, therefore, optional.

The lid is assembled by placing pressure directly down on the top surface of the lid. The lid bead locks slip over the container rim and lock under it. Accordingly, the lid does not require orientation when being assembled to the container.

The lid preferably includes a plurality of hinged venting doors formed in the center of the lid. The hinged doors are intended to keep dirt and dust from entering the lid. The venting doors open automatically when steam and heat build up during microwaving. The doors will also automatically close as the internal product cools down and the pressure is reduced. The central location of the venting area creates an effect similar to a chimney. Preferably the venting doors are located at or near the highest point on the lid when the lid is attached to a container.

The foregoing describes the invention in terms of embodiments foreseen by the inventor for which an enabling description was available, notwithstanding that insubstantial modifications of the invention, not presently foreseen, may nonetheless represent equivalents thereto.

BRIEF DESCRIPTION OF THE DRAWINGS

For the purpose of illustrating the invention, there is shown in the drawings embodiments that are presently preferred; it being understood, however, that this invention is not limited to the precise arrangements and constructions particularly shown. In the drawings.

DETAILED DESCRIPTION OF THE PREFERRED EMBODIMENTS

Figure 1:
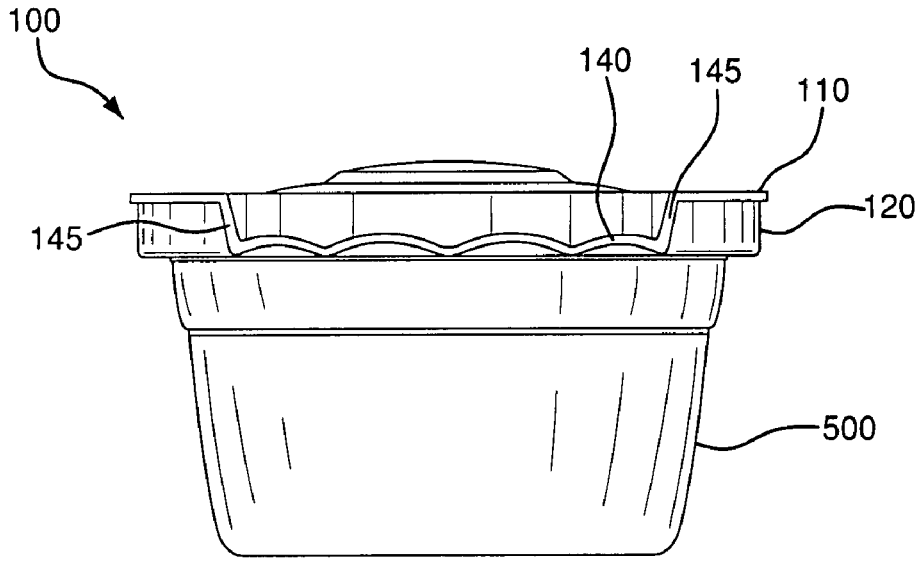
FIG. 1 is a side view of a container lid according to an embodiment of the present invention, installed on a container.

Referring now to the drawings wherein like reference numerals identify like elements, FIG. 1 shows a container 500 in combination with a removable locking container lid 100 according to the present invention. The container has an upper end having an open mouth. A removable top or shipping seal (not shown), such as a peel-off top with a ring-like opening tab, may be sealed to a rim or outer edge of the container to prevent the contents of the container from spilling. The user removes the top prior to use to expose the contents (not shown) of the container. With the top removed, the lid 100 may be attached or reattached to the container's upper end before moving or heating the container to reduce the risk of the contents spilling while the container is carried or splattering when the container is heated.

Figure 3:
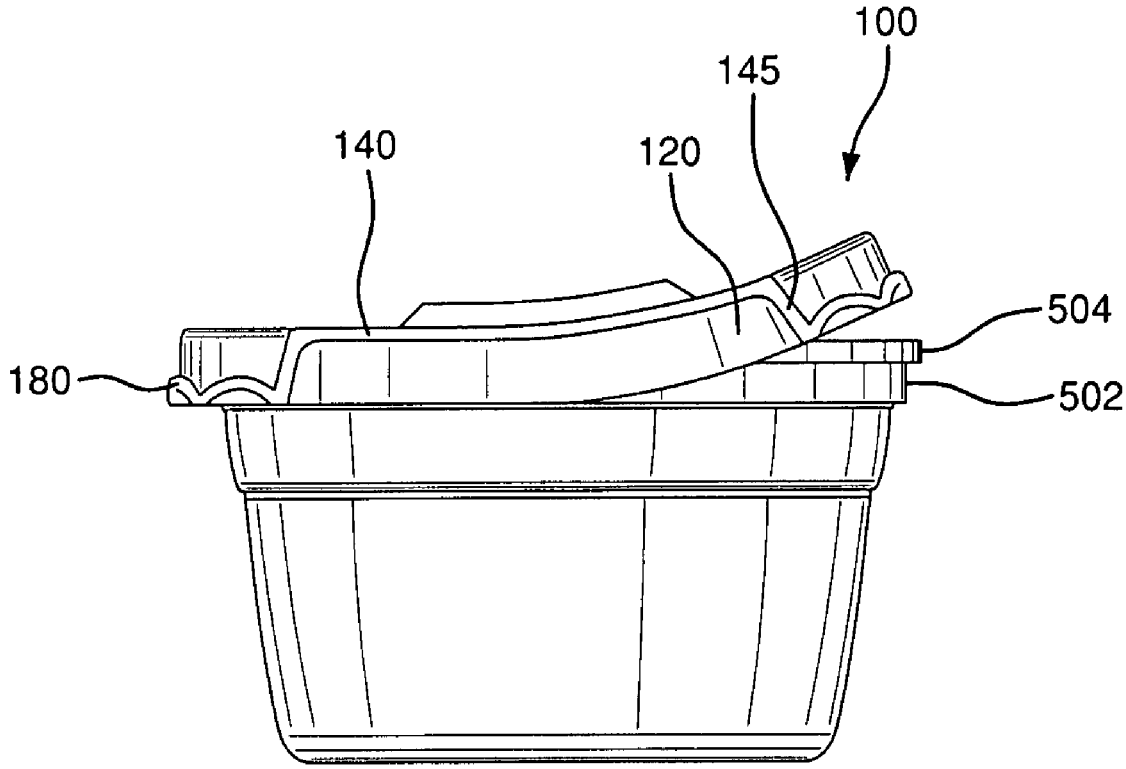
FIG. 3 is a side view of the lid of FIG. 1, showing the lid flexing while being opened.

The container 500 may be of any size or shape and may be fabricated from any of a variety of materials. Preferably, the container contains food products which are heated in a microwave oven prior to consumption. Therefore, the container is preferably fabricated from a material suitable for use with food products and for heating in a microwave, for example a thermoplastic material such as polypropylene formed by injection molding. As shown in FIG. 3, the container preferably includes a neck or rim 502 with a protruding lip having an outer bead ring 504, or similar structure proximate to its upper end. The outer bead ring may be disposed directly adjacent to the upper end of the container or in close proximity thereto. While the container 500 and the cover 100 are illustrated as each having a substantially circular shape, it will be appreciated that the teachings of the invention are applicable to a variety of other shapes. The following description and embodiments of the invention are not intended to describe all cover/container combinations, but are merely illustrative of how the teachings of the present invention may be employed in the context of a preferred container configuration.

Referring to FIG. 1, the container lid 100 has a top, a bottom, and a circumferential edge 110. When installed on the container, the top of the lid faces away from the container, and the bottom of the lid faces into the container. The cover also includes a skirt 120 extending downward from or near the circumferential edge 110 of the lid. The skirt has an inner surface (or wall) and an outer surface (or wall). When installed on the container, the outer wall faces away from the container, and the inner wall faces toward the container, and is preferably shaped to fit snugly around the outside of the container neck and/or outer bead ring.

Figure 2:
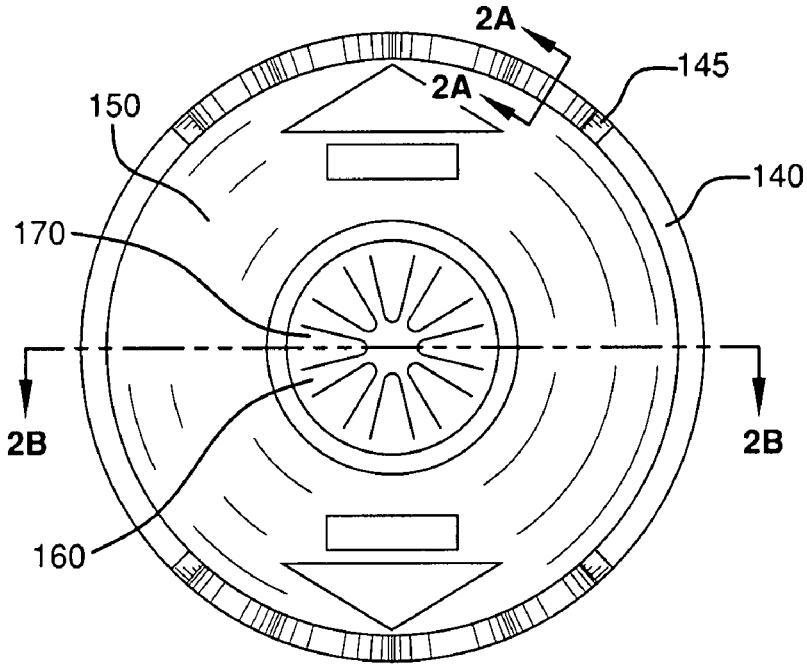
FIG. 2 is a plan view of the top of the container lid of FIG. 1.

FIG. 2 is a plan view of the cover of FIG. 1, showing a center section 130, including an annular surface 150, an upper portion 160, and hinged venting doors 170.

Figure 2A:
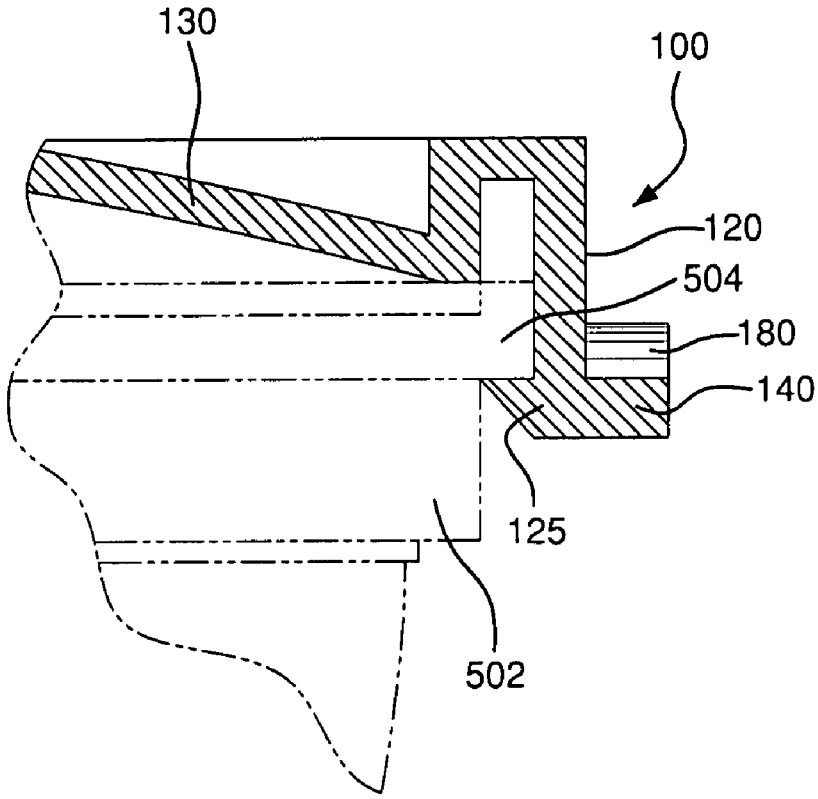
FIG. 2A is an enlarged partial section view of the lid of FIG. 2 taken along line 2A-2A.
Figure 2B:
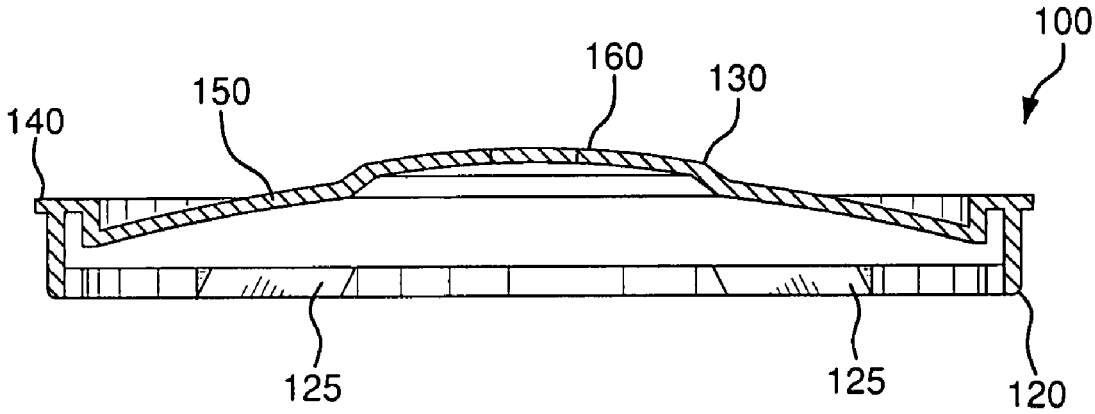
FIG. 2B is a cross-sectional view of the lid of FIG. 2 taken along line 2B-2B.

FIG. 2A is an enlarged partial section view of the cover of FIG. 2 along line 2A-2A. The lid 100 includes the skirt 120, as hereinbefore described, circumscribing the center section 130. The skirt 120 features at least one integrally-molded bead 125 on its inner surface; the bead is shaped to mate to the outer bead ring 504 (not shown) of the container. The bead 125 is preferably sized to correspond to the width of the container's outer bead ring, such that the bead ring engages substantially all of the outer bead 504 between its outer edge and its junction with the container neck or rim 502, as seen in FIG. 2A. As also seen in FIG. 2A, the skirt 120 is preferably sized so that the skirt's inner diameter is substantially equal to the container bead's outer diameter. This provides a more secure locking action and allows the inner surface or wall of the skirt 120 to seal snugly against the outer surface of the container bead ring 504, creating a more secure seal for the container's contents.

Figure 4:
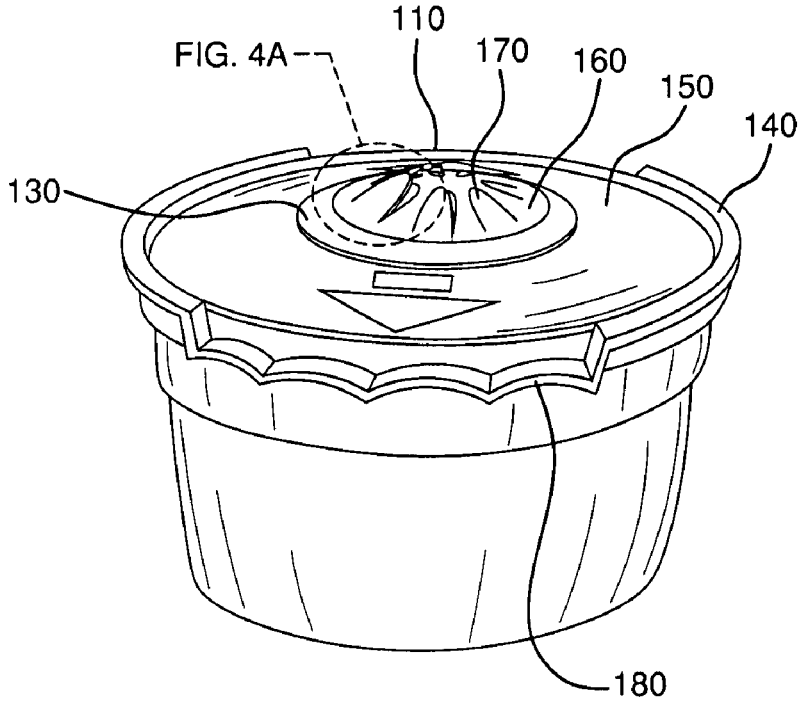
FIG. 4 is an isometric view of the lid of FIG. 1 installed on a container.

As shown in FIGS. 1 and 4, the skirt also features a flange 140, which is preferably formed completely around the outside of the skirt 120. Forming a continuous flange completely around the cover provides for increased strength and stiffness, allowing the cover to retain its shape and sealing ability when heated. As shown, a first portion of the flange extends radially outward the top of the skirt along at least one portion of the lid. A second portion of the flange extends radially outward from the bottom or the skirt. Preferably, the flange has two first portions and two second portions. The flange 140 includes transition points or sections 145 that step diagonally between the first portion of the flange and the second portion of the flange.

Locating the flange along different portions of the skirt about the circumference is desirable since it provides flexibility and ease of use, while retaining the strength and stiffness imparted by the continuous flange. Positioning the flange near the bottom of the skirt at the different portions of the skirt where it is intended for the user to lift the lid provides increased leverage for the user, compared to positioning the flange along the top of the skirt. However, extending the flange from the top of the skirt at other points allows the skirt to flex more easily, further easing removal. If the flange were to extend from the bottom of the skirt at these points, it would reduce the lid's flexibility because the flange would be forced to stretch as well as flex. Positioning the flange at the top of the skirt eliminates the need for the flange to stretch, thus increasing the lid's flexibility.

Center section 130 includes an outer annular surface 150 surrounding an upper portion 160. The upper portion includes hinged vents or venting doors or flaps 170.

FIG. 4 is an isometric view of the lid 100 of FIG. 1. In this figure the circumferential edge 110 of the top can be seen. The flange 140 extends radially outward from the diameter of skirt 120 to provide the user with a surface to grip when removing the cover. The flange 140 also preferably includes a scalloped edge 180, which defines one or more finger grips that provide a more ergonomic interface for a user's fingertips.

Also visible in FIG. 4 is a preferred embodiment of the center section 130. The center section 130 may be convex or an inverted frusto-conical shape in the upper portion, so as to form a peak in the lid which directs steam inside the container to the high point in the lid. The venting doors 170 are preferably located in the upper portion. This shape promotes the venting of the container through the hinged venting doors 170. When the contents of the container are heated, steam rises to the highest point in the container. In the preferred embodiment shown in FIG. 4, the shape of the center section funnels the steam to the center, where the venting doors are located.

Figure 4A:
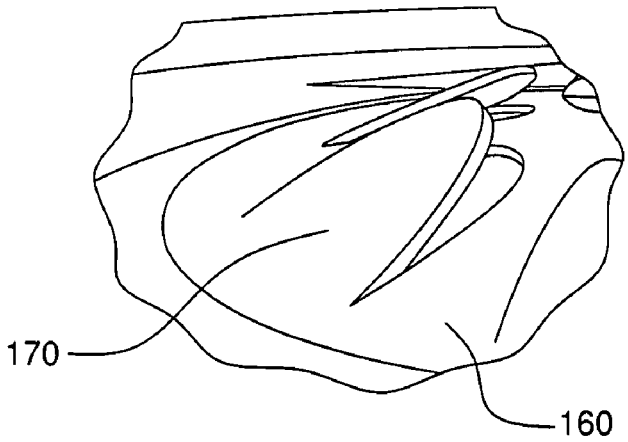
FIG. 4A is an enlarged view of a portion of the lid of FIG. 4, showing the hinged venting doors.

The venting doors are preferably formed integral with the lid 100, and may be formed by any number of processes, such as laser cutting, punching, etc. As shown in FIG. 4A, the venting doors 170 may be created by cutting through center section 130 in an arched cut, forming a living hinge along the attached portion. It will be appreciated by those of ordinary skill in the art that the hinge stiffness (i.e., the doors' resistance to opening) may be manipulated by changing the type or thickness of the lid material or the shape of the cut. The hinge stiffness may also be changed by scoring the hinge line or otherwise making the material along the line thinner. It will also be appreciated by those of ordinary skill that the venting doors may be integral with the cover, or may be separate parts added using any of a number of connecting means, such as adhesives or other attaching means.

The venting doors are preferably formed near the highest portion of the center section, and oriented so that the tips or points of the venting doors are directed toward the highest point of the cover. As pressure builds up inside the container through heating, the pressure from the steam inside forces the venting doors 170 open, releasing steam and pressure until the pressure subsides to a level insufficient to maintain the doors in their open position. Orienting the venting doors so that each door's tip (i.e., the end of the vent furthest from the hinge) is nearest the highest point on the cover allows for the most effective pressure relief because the pressure will be greatest at the highest point of the cover. The vents will thus open sooner and close later during the heating and cooling cycle of the container's contents. The doors may also serve as visual indicators of the temperature of the container's contents; when the doors are open, a user may conclude that the container's contents are extremely hot. Conversely, when the doors are closed, the user may conclude that the contents are likely cool enough to be handled.

FIG. 4 is an isometric view of the cover of FIG. 1. This figure more clearly illustrates the manner in which the cover would be removed from a container. As can be seen in FIG. 4, circumferential flange 140 provides a gripping surface for the user's fingertips. To remove the container, the user places his fingertips under flange 140 and pulls upwards. As shown in FIGS. 3 and 2A, the lid 100 flexes as the user pulls on flange 140. As the lid flexes, the transition sections 145 bear the bending load and transfer it to the portion of the flange extending from the top of the skirt, reducing the tension forces created in the skirt near the transition sections. The flexure causes beads 125 to disengage from the outer bead ring or neck of the container.

To attach the lid to a container, the user simply places the lid in position on top of the container, then applies pressure downward on the top surface, forcing the beads 125 to engage the container bead ring. In a preferred embodiment, flange 140 provides two gripping surfaces located on substantially opposite sides of the lid so that a user may open the lid by pulling on either side.

The lid, flange, and skirt are all preferably formed as an integral injection molded unit from thermoplastic material such as polypropylene in a one piece construction using an injection molding process. It should be appreciated, however, that the lid of the present invention may be made of any of a number of materials, or out of several pieces attached together. Such differences in manufacturing and assembly do not impact the relevant form and function of the claimed invention. The lid is preferably microwavable and easily removed and reapplied to the container by the user. It is contemplated that the cover can be placed onto the container during an assembly process at the factory, thus keeping the top surface of the container completely sealed, clean and dry during shipping and storage. In an exemplary implementation, after the user has removed the lid, the user opens the container, such as by pulling upward on a now exposed metal ring tab of a sealed container top, completely separating the top from the container and discarding it. Next the user replaces the cover and places the container with cover into a microwave.

It will be apparent to those skilled in the art that various modifications and variations can be made in the configuration of the present invention without departing from the spirit or scope of the invention. It is intended that the present invention cover such modifications and variations provided they come within the scope of the appended claims or their equivalents.

What is claimed is:

1. A removable locking container lid for covering a container having neck including an outwardly protruding rim, the lid comprising:

a top, a bottom, and a circumferential edge;

a skirt extending downward from the lid at or near the circumferential edge, the skirt having a bottom edge, an inner surface and an outer surface, the inner surface shaped to removably attach to the outside of the container neck; and a circumferential flange extending radially outward from the lid, the flange having at least two first portions located approximately at the top of the skirt and extending radially outward from the outer surface of the skirt, at least two second portions located approximately at the bottom of the skirt and extending radially outward from the outer surface of the skirt, and each end of a first portion being connected to a corresponding end of a second portion by a transition section;

wherein the skirt includes at least one integral bead protruding inwardly from the inner surface of the skirt at a location opposite each of the second portions to engage a bottom surface of the outwardly protruding rim of the container neck;

wherein at least one second portion includes a contoured gripping surface defined by at least three arcuate segments that form finger grips; and wherein the skirt extends above a portion of the top such that the first portion of the flange is located above the top at its circumferential edge while the second portion of the flange is located below the top at its circumferential edge.

2. The container lid of claim 1, wherein the second portions of the flange are located on substantially opposite sides of the lid.

3. The container lid of claim 1, wherein the skirt includes at least two integral beads, each bead located adjacent to a gripping section.

4. The container lid of claim 1, wherein the lid includes a center section located on the top surface of the lid, the center section including a lower annular surface circumscribing an upper portion, the upper portion including at least one venting door which is adapted to permit air to pass from one side of the lid to the other under certain conditions.

5. The container lid of claim 4, wherein the at least one venting door is formed from a cut portion of the lid and attached to the lid on one side so as to create a living hinge.

6. The container lid of claim 4, wherein the center section includes a series of venting doors arranged in a circular pattern around the center point of the lid, the venting doors being substantially equidistant from the center and spaced substantially equally apart from each other.

7. The container lid of claim 1, wherein the lid is circular in shape and wherein the flange is located on a radially outer edge of the top.

8. A removable locking container lid for covering a container having a neck, the lid comprising:

a top, a bottom, and a circumferential edge;

a skirt extending downward from the lid at or near the circumferential edge, the skirt having a bottom edge, an inner surface and an outer surface, the inner surface being shaped to removably attach to the outside of the container neck; and a circumferential flange extending radially outward from the lid, the flange having at least one first portion located approximately at the top of the skirt and extending radially outward from the outer surface of the skirt, at least one second portion located approximately at the bottom of the skirt and extending radially outward from the outer surface of the skirt, and a transition section joining one end of the first portion and one end of the second portion;

wherein the skirt includes an integral bead protruding inwardly from the inner surface of the skirt at a location opposite the second portion the flange to engage a bottom surface of an outwardly protruding rim of the container neck;

wherein the at least one second portion includes a contoured gripping surface defined by at least three arcuate segments that form finger grips; and wherein the skirt extends above a portion of the top such that the first portion of the flange is located above the top at its circumferential edge while the second portion of the flange is located below the top at its circumferential edge.

9. The container lid of claim 8, wherein the lid includes a center section located on the top surface of the lid, the center section including a lower annular surface circumscribing an upper portion, the upper portion including at least one venting means which is adapted to permit air to pass from one side of the lid to the other under certain conditions.

10. The container lid of claim 9, wherein the at least one venting means is an integral vent door with a living hinge, the door adapted to open when the difference in pressure on opposite sides of the lid exceeds a threshold value.

11. The container lid of claim 8, wherein the flange includes at least two first portions and at least two second portions, and wherein each end of a first portion is connected to a corresponding end of a second portion by a transition section.

12. The container lid of claim 9, wherein the at least one venting means is a plurality of integral vent doors arranged in a circular pattern, each door having a living hinge at a radially outward edge of the door such that when the vent door opens, venting air is directed toward the center of the lid.

* * * * *